US006513672B1

(12) United States Patent
Ovadia

(10) Patent No.: US 6,513,672 B1
(45) Date of Patent: Feb. 4, 2003

(54) HINGED JEWELRY CASE WITH GLUELESS FABRIC INSERT

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 0 days.

(21) Appl. No.: 09/777,089

(22) Filed: Feb. 5, 2001

(51) Int. Cl.[7] ..... B65D 23/02
(52) U.S. Cl. ..... 220/495.01; 206/6.1; 220/829
(58) Field of Search ..... 206/6.1, 557, 566; 220/829, 495.01

(56) References Cited

U.S. PATENT DOCUMENTS 1,618,561 A * 2/1927 Warner ..... 206/6.1
1,695,802 A * 12/1928 Dreux ..... 206/6.1
1,906,822 A * 5/1933 Shields ..... 206/6.1
2,126,049 A * 8/1938 Shiffman et al. ..... 220/829
2,353,522 A * 7/1944 Stern ..... 206/6.1
2,505,156 A * 4/1950 Sofo ..... 206/6.1
2,581,615 A * 1/1952 Whitelaw ..... 206/557
3,937,319 A * 2/1976 Roy ..... 206/6.1
4,101,023 A * 7/1978 Schuander ..... 206/566
4,413,736 A * 11/1983 Nibling ..... 206/566

OTHER PUBLICATIONS

Jewelpak brochure, pp. 2, 16, 17, cover sheet and back sheet, Jan., 2001.

* cited by examiner

*Primary Examiner*—Jim Foster
(74) *Attorney, Agent, or Firm*—Richard M. Goldberg

(57) ABSTRACT

A case includes a base having a bottom wall, a peripheral side wall connected to the bottom wall, and a first inwardly extending retaining ledge connected to the upper end of the peripheral wall; a top cover having a top wall, a peripheral side wall connected to the top wall such that a cavity is defined in the case when the jewelry case is in a closed condition, and a second inwardly extending retaining ledge connected to the lower end of the peripheral wall of the top cover; a hinge which pivotally connects together the base and the top cover; and a fabric covering which covers inner surfaces of the top cover and the base, the fabric covering having edges retained under the first and second inwardly extending retaining ledges to retain the fabric covering in position without adhesive.

4 Claims, 18 Drawing Sheets

FIG. 15
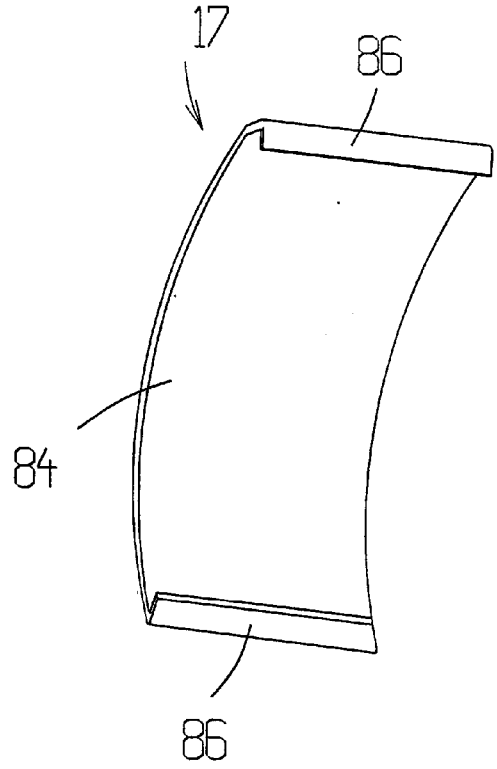
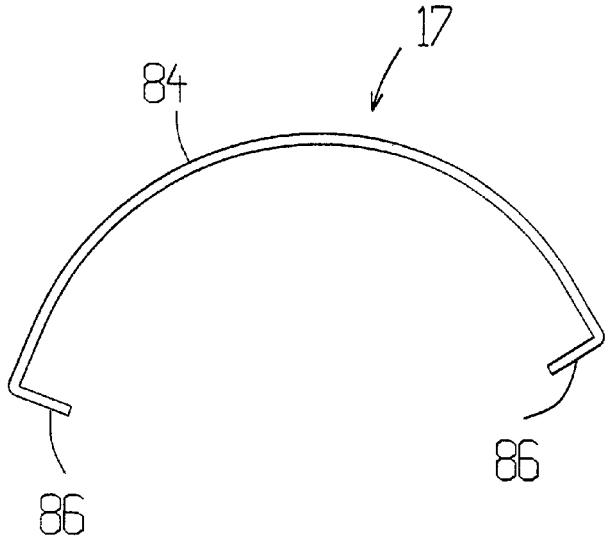
FIG. 16

HINGED JEWELRY CASE WITH GLUELESS FABRIC INSERT

BACKGROUND OF THE INVENTION

The present invention relates generally to display and storage devices, and more particularly, is directed to a jewelry case for storing and displaying jewelry items.

It is known to provide a fabric insert within a jewelry case to provide an aesthetic appearance, to hold the jewelry, and at the same time covering and hiding the plastic or wooden case and the hinge assembly. Thus, the hinge assembly and case do not detract from the appearance of the jewelry within the jewelry case. Conventionally, fabric inserts have been glued or otherwise adhered within jewelry cases. However, this results in an additional material, namely the adhesive. Also, positioning of the fabric inserts in a jewelry case with an adhesive is a difficult job, since alignment must be perfect before the adhesive dries. Further, if the fabric inserts become soiled or otherwise need to be changed, there is no way to replace the fabric inserts, and as a result, the entire jewelry case must be thrown away. This is because the fabric insert is permanently mounted in the case.

It is also known to provide metal jewelry cases having inwardly rolled or turned metal edges, which help to lock a fabric insert into the case. Examples of these are sold by Jewelpak, 2640 E. 37th Street, Vernon, Calif. 90058 under the trademark "SOFTOUCH." However, the walls of the case must be very thin to permit the bending of the sheet metal, and these cases must be manufactured from metal. The primary reason is to eliminate exposure of the rough edges. Although a fabric insert is held beneath the rolled edges, the inner lip provided by the rolled edges is of a very small dimension and is therefore of a very small inwardly directed depth. Thus, it could not be used to hold a pad in the jewelry case. Also, the inwardly directed depth of the walls must be constant throughout, and there is no possibility of varying the depth for certain walls relative to other walls. Further, such arrangement could not be provided for jewelry boxes made of other materials, such as plastic, wood, etc., since these materials cannot be rolled. Lastly, this case must provide the rolled edge substantially around the entire periphery and at all four corners. Otherwise, the jewelry case will look incomplete and not aesthetically pleasing.

OBJECTS AND SUMMARY OF THE INVENTION

Accordingly, it is an object of the present invention to provide a jewelry case that overcomes the problems with the aforementioned prior art.

It is another object of the present invention to provide a jewelry case having a fabric insert held therein without an adhesive.

It is still another object of the present invention to provide such a jewelry case having an inwardly extending retaining ledge at the open edges of the top cover and base for holding a fabric insert therein.

In accordance with an aspect of the present invention, a case includes a base having a bottom wall, a peripheral side wall connected to the bottom wall, and a first inwardly extending retaining ledge connected to the upper end of the peripheral wall; a top cover having a top wall, a peripheral side wall connected to the top wall such that a cavity is defined between the top wall and the peripheral side wall of the top cover and the bottom wall and the peripheral side wall of the base when the jewelry case is in a closed condition, and a second inwardly extending retaining ledge connected to the lower end of the peripheral wall of the top cover; a hinge which pivotally connects together the base and the top cover; and a fabric covering which covers inner surfaces of the top cover and the base, the fabric covering having edges retained under the first and second inwardly extending retaining ledges to retain the fabric covering in position without adhesive.

The peripheral side wall of the base has an upper surface, and the first inwardly extending retaining ledge has an upper surface which is coplanar and forms a continuation of the upper surface of the peripheral side wall of the base. In like manner, the peripheral side wall of the top cover has a lower surface, and the second inwardly extending retaining ledge has a lower surface which is coplanar and forms a continuation of the lower surface of the peripheral side wall of the top cover.

Each of the retaining ledges extends inwardly in substantially perpendicular relation from the respective peripheral side walls.

The first inwardly extending retaining ledge has a lower surface which is substantially parallel with the upper surface of the first inwardly extending retaining ledge and extends inwardly in substantially perpendicular relation from the respective peripheral side walls; and the second inwardly extending retaining ledge has an upper surface which is substantially parallel with the lower surface of the second inwardly extending retaining ledge and extends inwardly in substantially perpendicular relation from the respective peripheral side walls.

The fabric covering includes a top covering section which covers the inner surfaces of the top cover; a bottom covering section which covers the inner surfaces of the base; and a hinge covering section which connects together the top covering section and the bottom covering section.

The peripheral side wall of the base includes a front wall, a rear wall and opposite side walls connecting together the front wall and the rear wall, and the bottom covering section includes a first section for covering the bottom wall, a second section connected along a fold line with the first section for covering one side wall and a third section connected along a fold line with the first section for covering the other side wall. In like manner, the peripheral side wall of the top cover includes a front wall, a rear wall and opposite side walls connecting together the front wall and the rear wall, and the top covering section includes a fourth section for covering the top wall, a fifth section connected along a fold line with the fourth section for covering one side wall of the top cover and a sixth section connected along a fold line with the fourth section for covering the other side wall of the top cover. The hinge covering section connects the first and fourth sections together.

The above and other objects, features and advantages of the invention will become readily apparent from the following detailed description thereof which is to be read in connection with the accompanying drawings.

BRIEF DESCRIPTION OF THE DRAWINGS

FIG. 15 is a perspective view of the C-clip;

FIG. 16 is a side elevational view of the C-clip;

DETAILED DESCRIPTION

Figure 1:
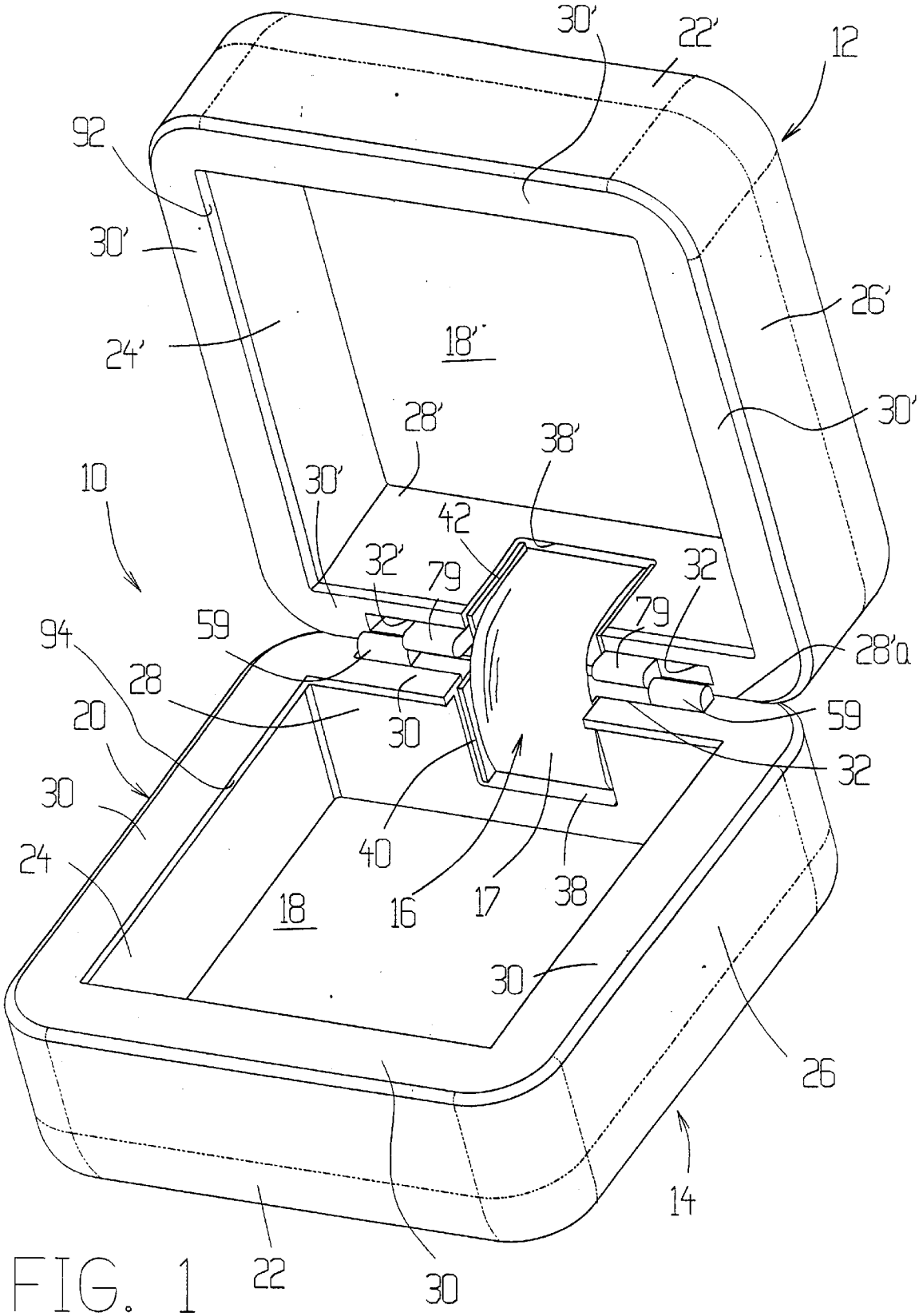
FIG. 1 is a perspective view of a jewelry case in an open condition, according to the present invention.

Referring to the drawings in detail, and initially to FIG. 1 thereof, a jewelry case 10 according to the present invention includes a top cover 12 and a base 14 hinged together by a spring hinge 16 which is not visible from the exterior of case 10. Spring hinge 16 functions to automatically force top cover 12 into an open position during an opening operation and into a closed position during a closing operation after top cover 12 has pivoted a predetermined angle relative to base 14. Top cover 12 and base 14 have an essentially identical configuration. Therefore, the structure of base 14 will be discussed, with the understanding that this description also applies to top cover 12, and the same elements of top cover 12 are denoted by a prime (') after the number.

Figure 2:
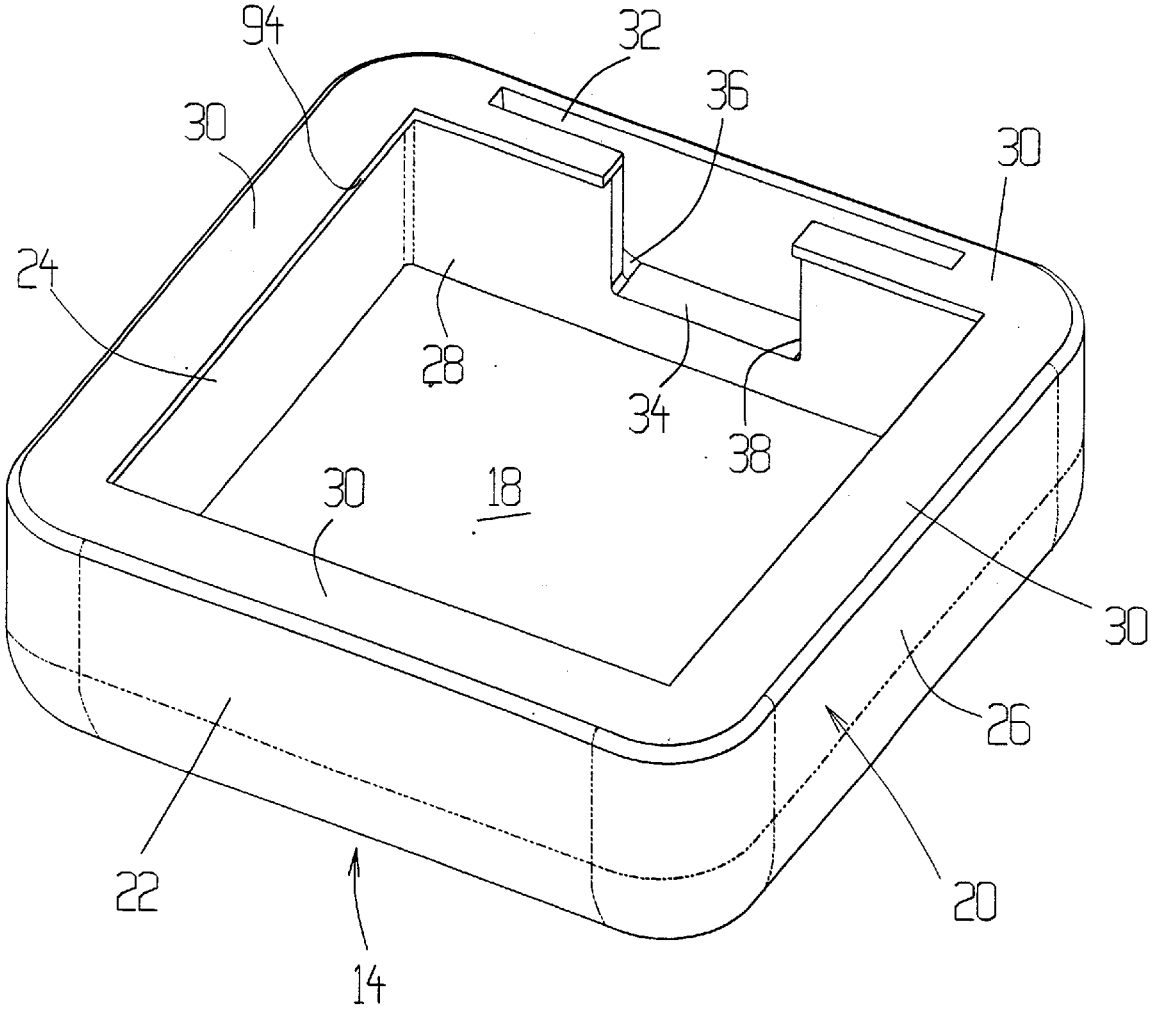
FIG. 2 is a perspective view of the base of the jewelry case, with the top cover being substantially identical.
Figure 3:
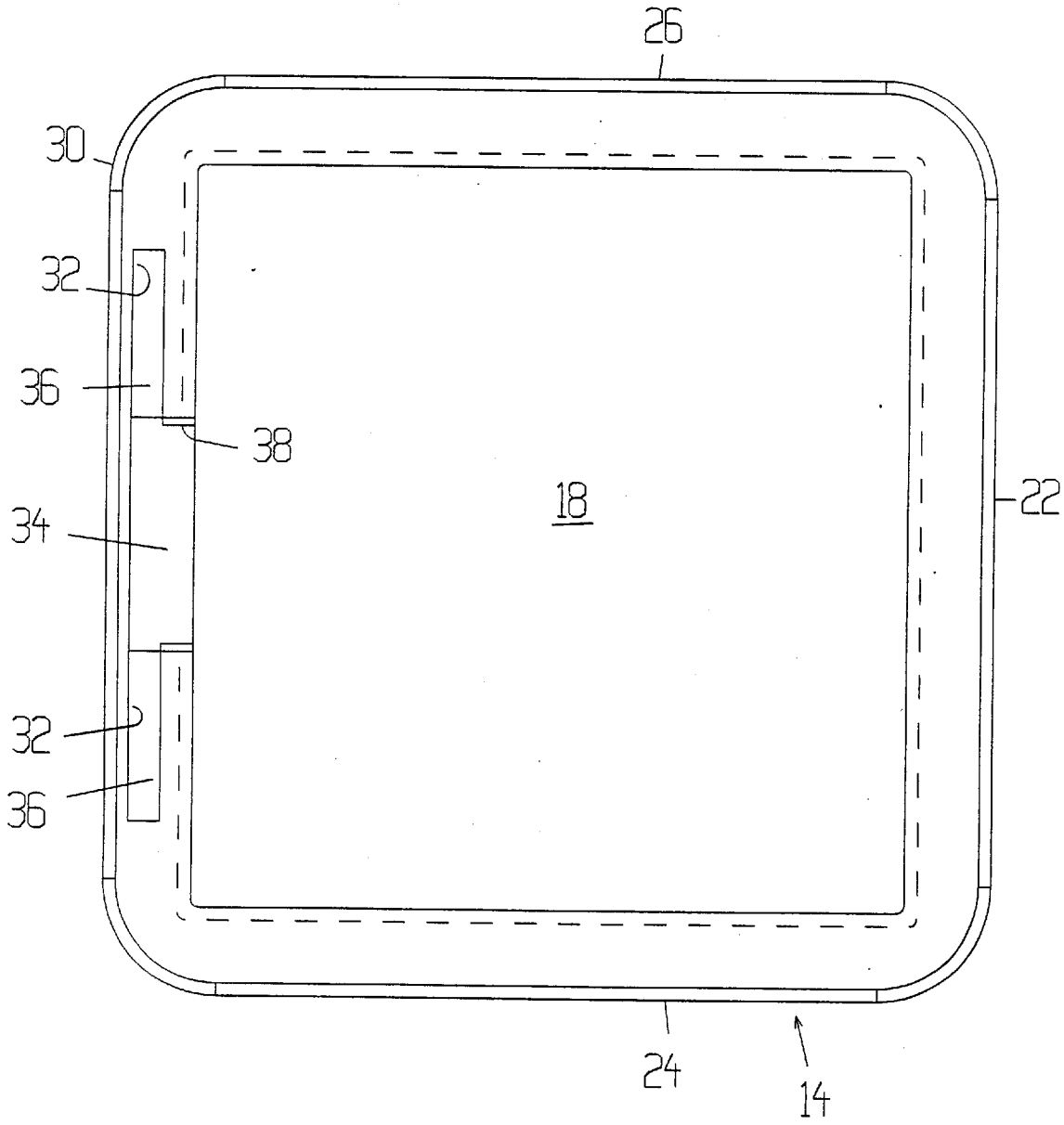
FIG. 3 is a top plan view of the base.
Figure 5:
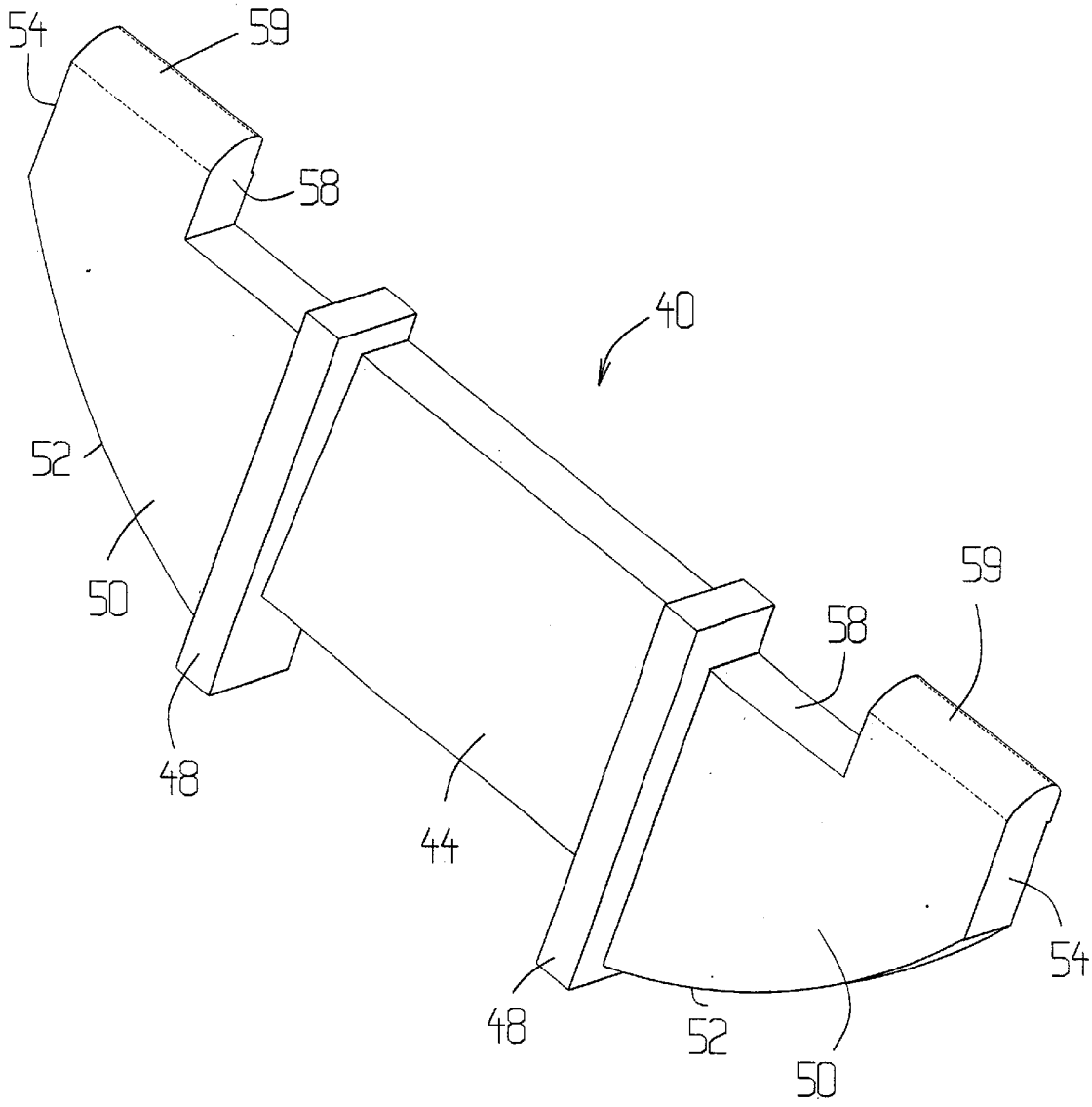
FIG. 5 is a perspective view of a first retainer to be mounted to the base, viewed from a top, front thereof.
Figure 6:
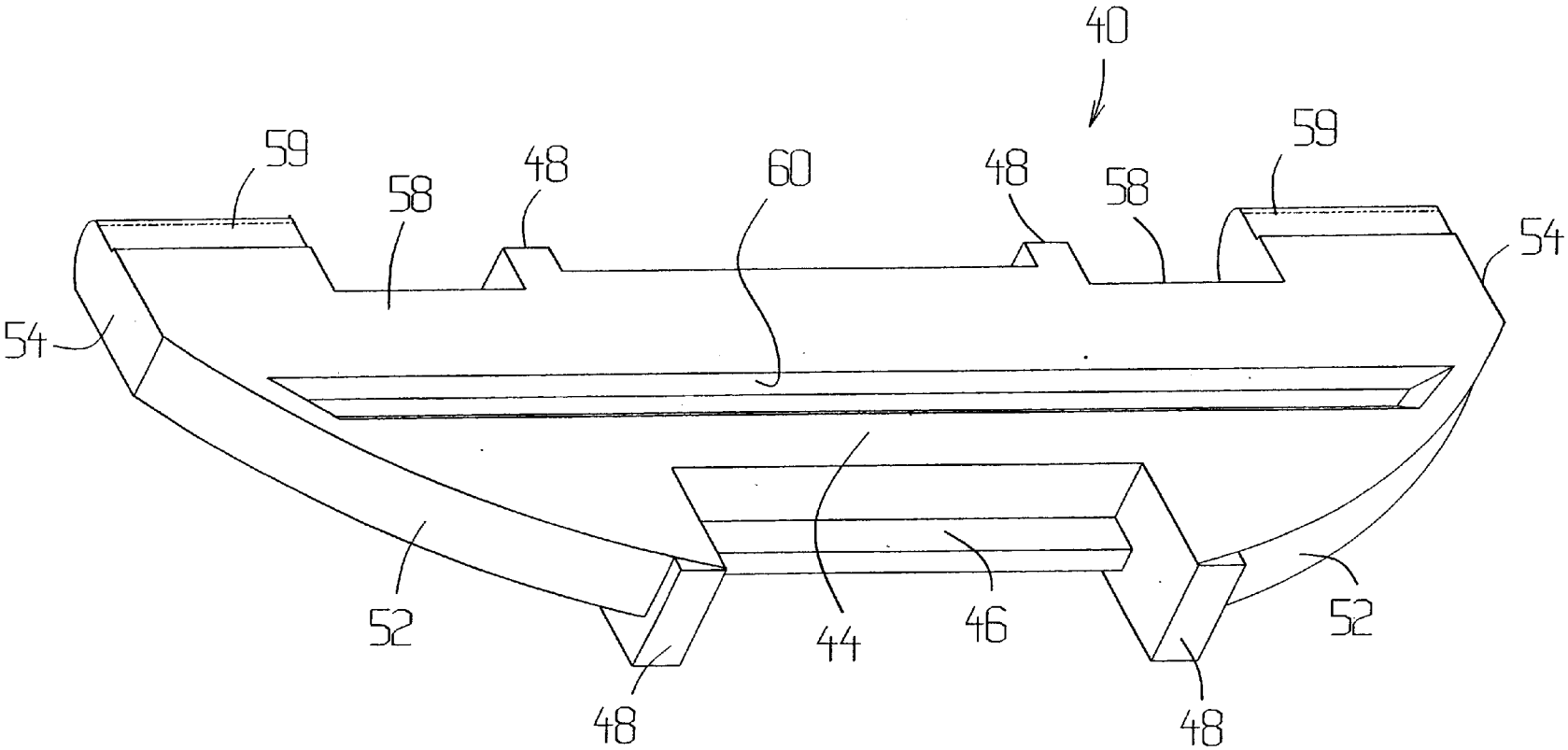
FIG. 6 is a perspective view of the first retainer, viewed from a bottom, rear thereof.
Figure 7:
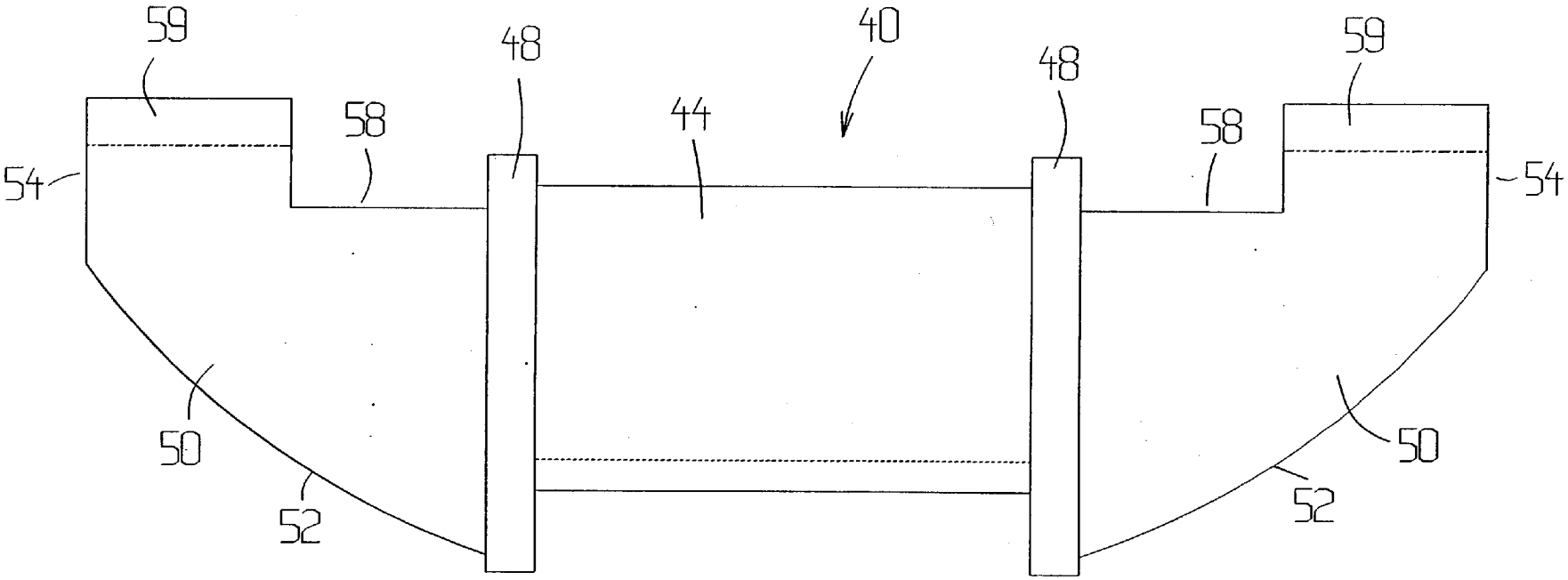
FIG. 7 is a front elevational view of the first retainer.
Figure 8:
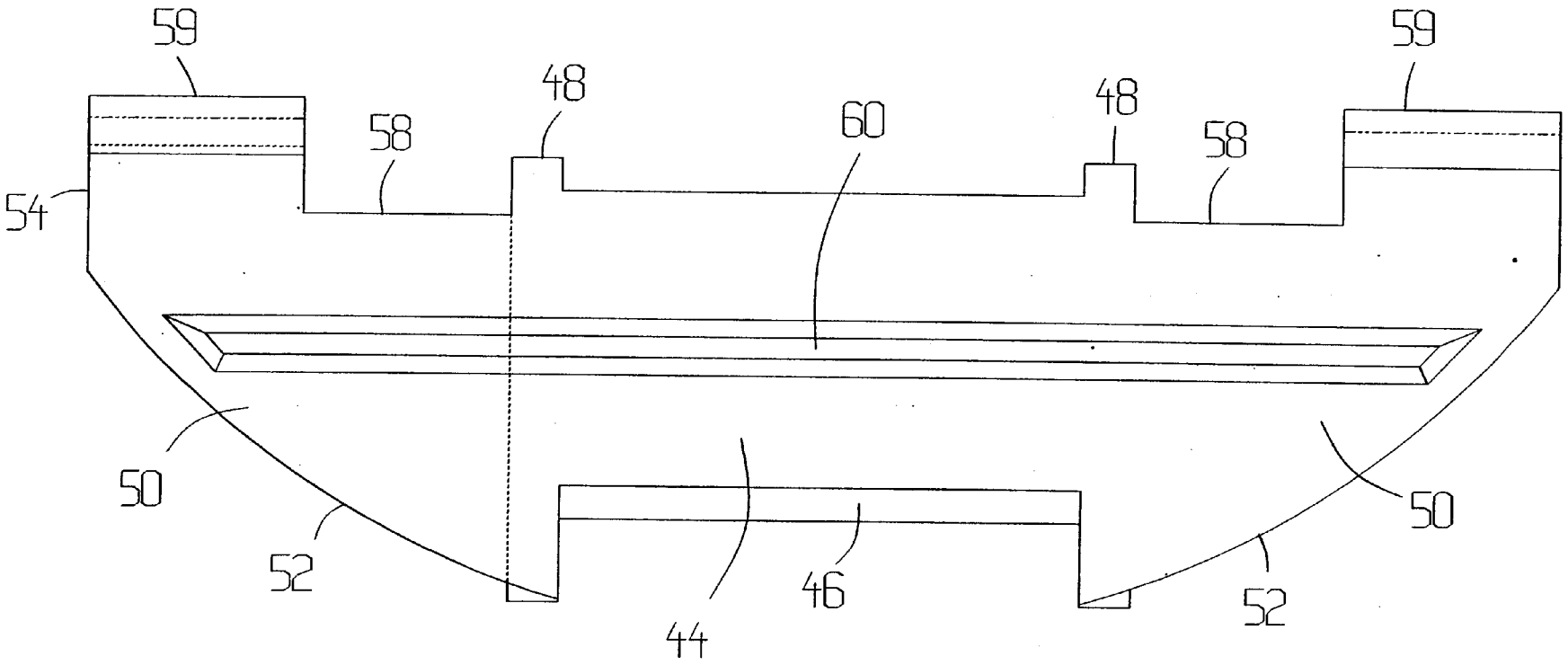
FIG. 8 is a rear elevational view of the first retainer.
Figure 9:
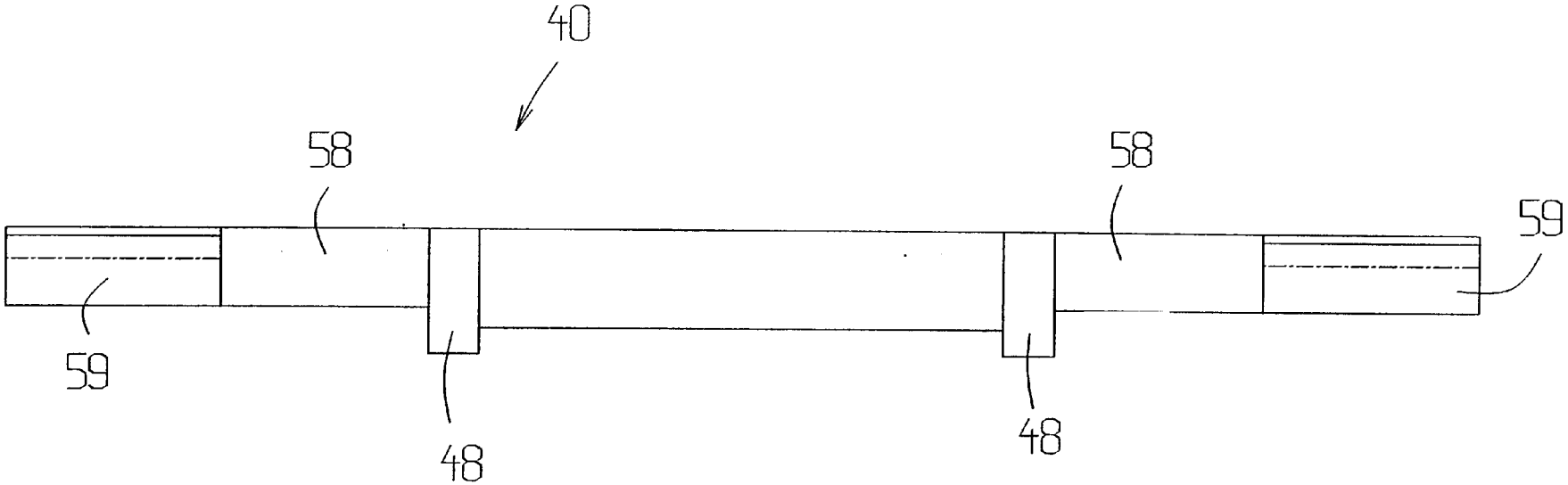
FIG. 9 is a top plan view of the first retainer.
Figure 10:
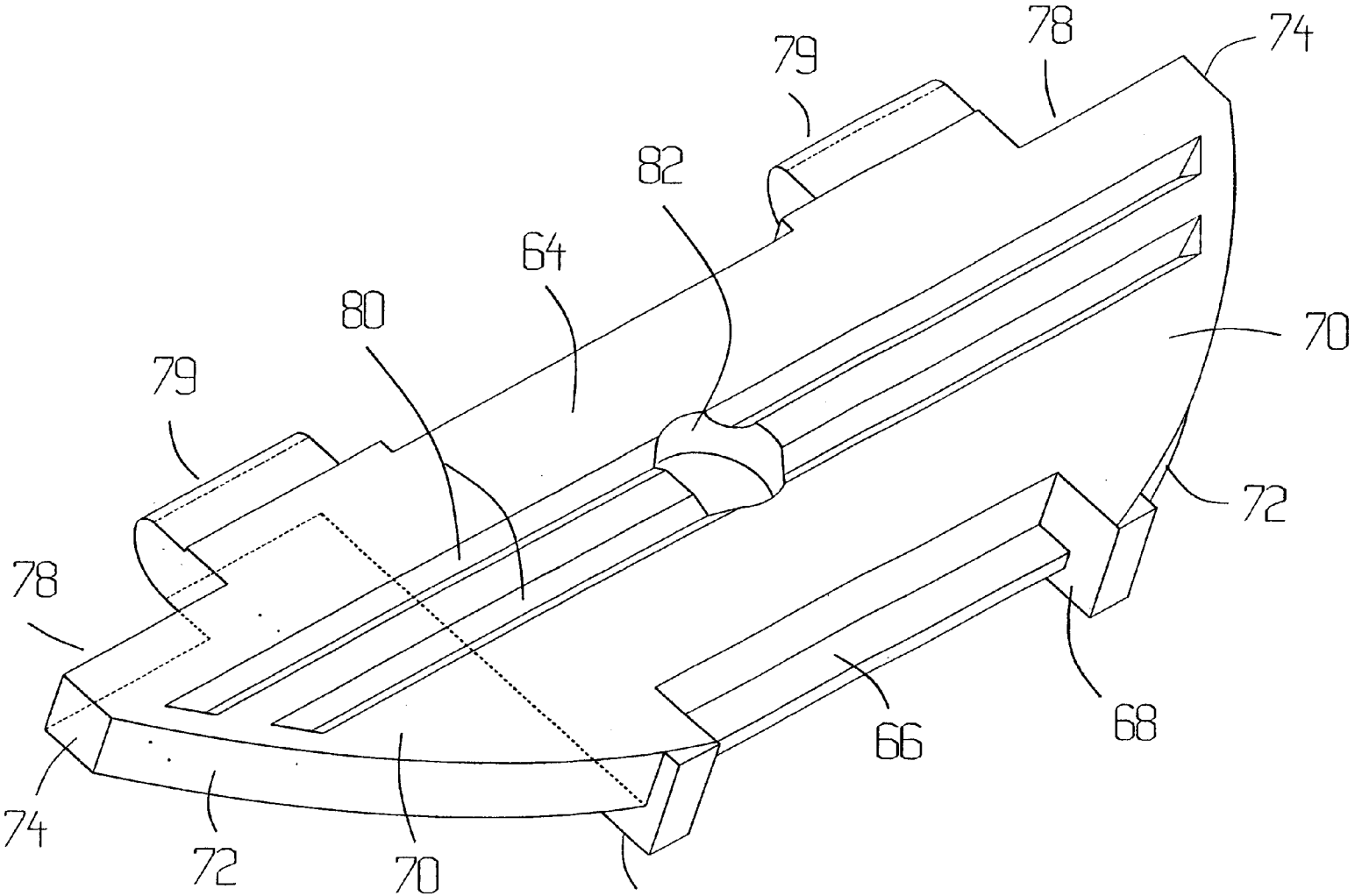
FIG. 10 is a perspective view of the second retainer to be mounted to the top cover, viewed from a bottom, rear thereof.
Figure 11:
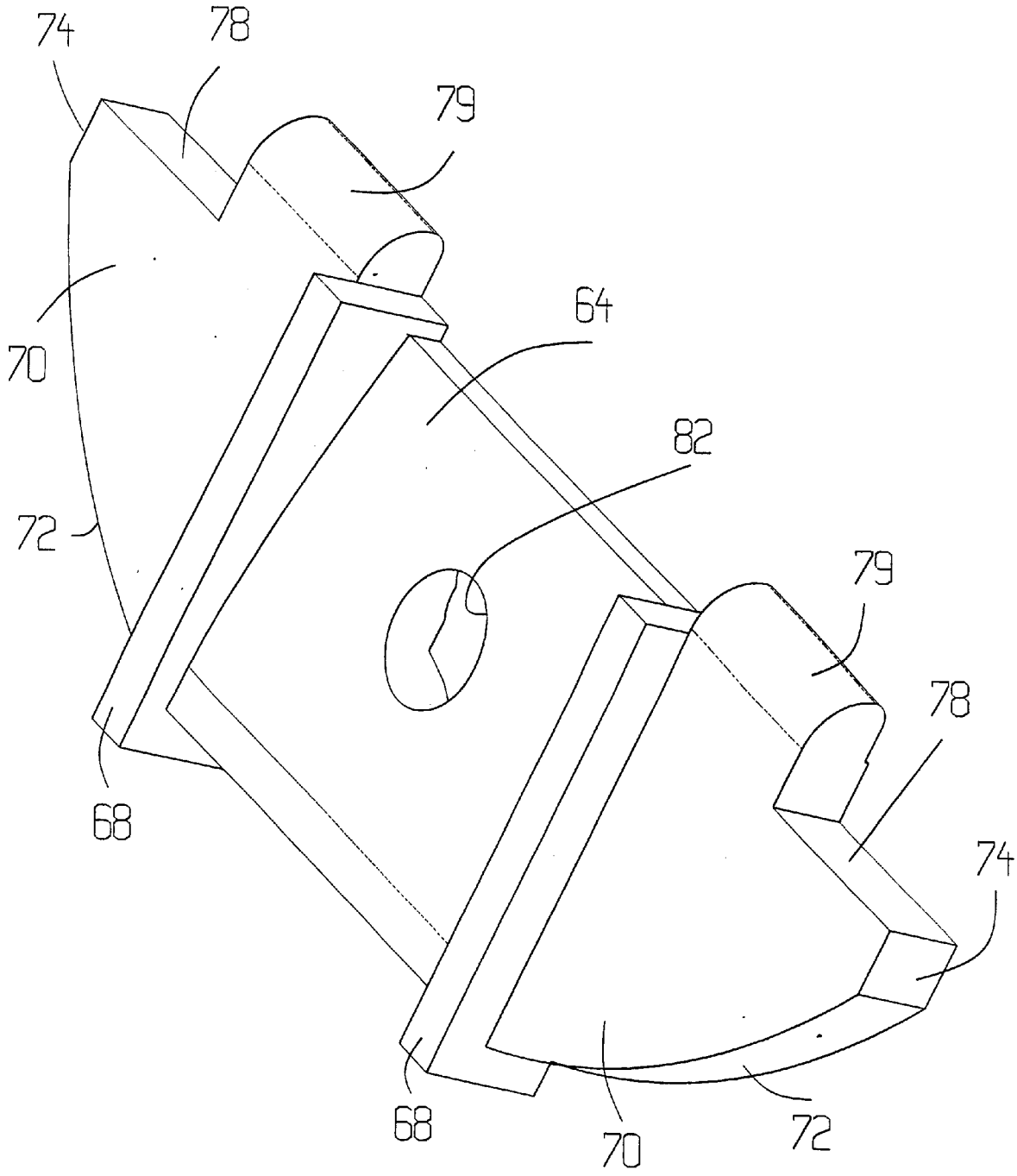
FIG. 11 is a perspective view of the second retainer, viewed from a top, front thereof.
Figure 12:
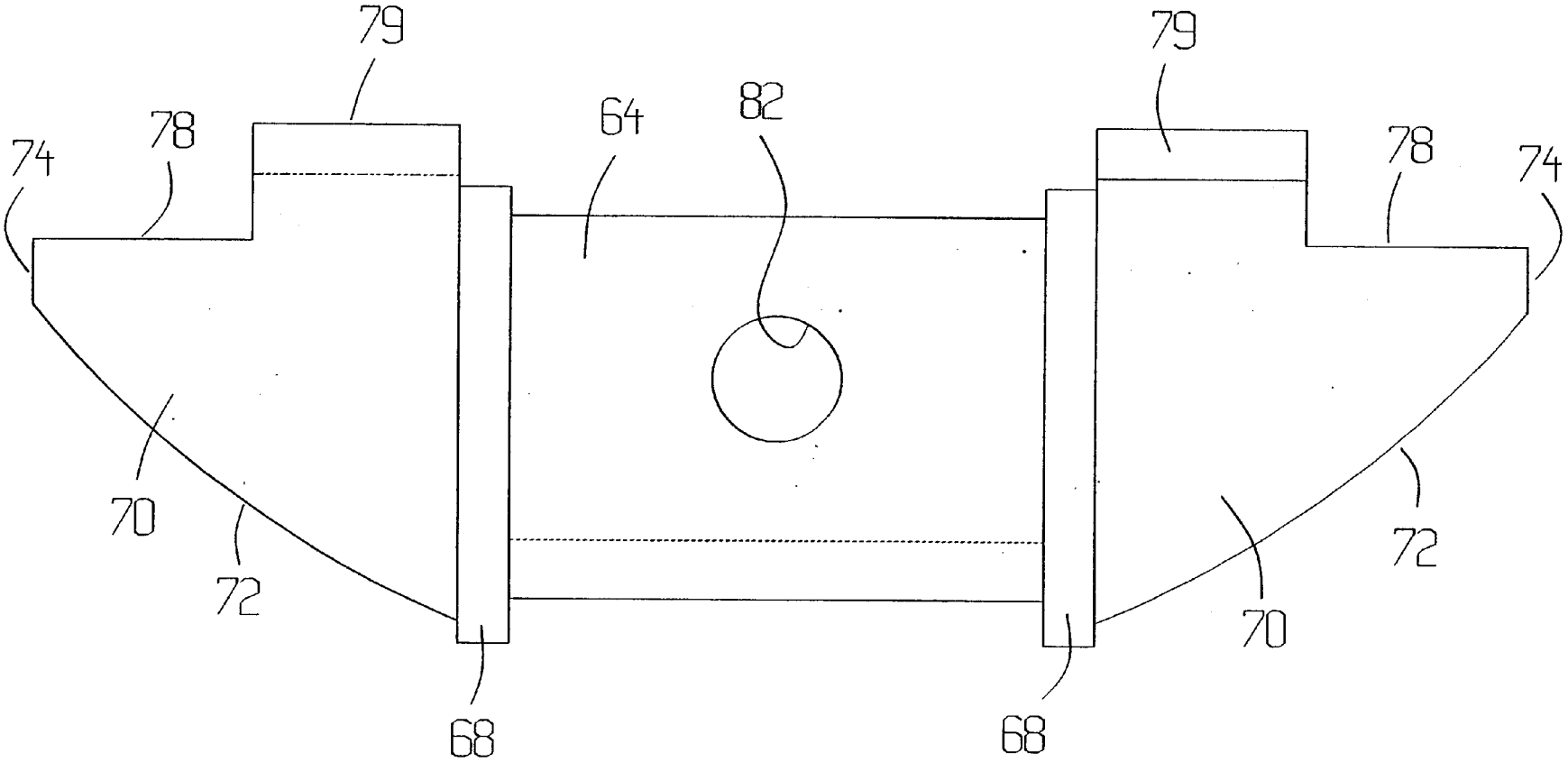
FIG. 12 is a front elevational view of the second retainer.
Figure 13:
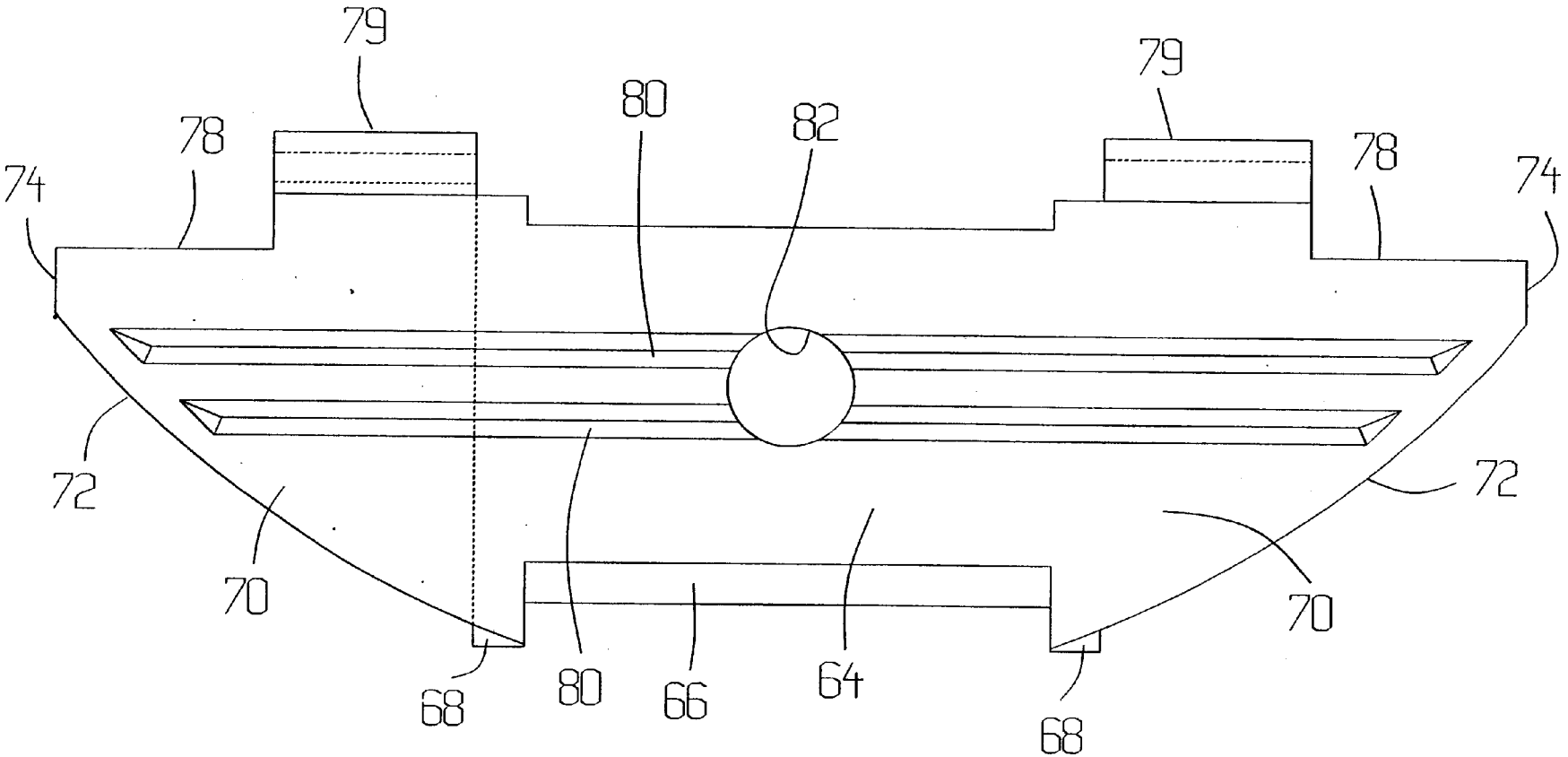
FIG. 13 is a rear elevational view of the second retainer.
Figure 14:
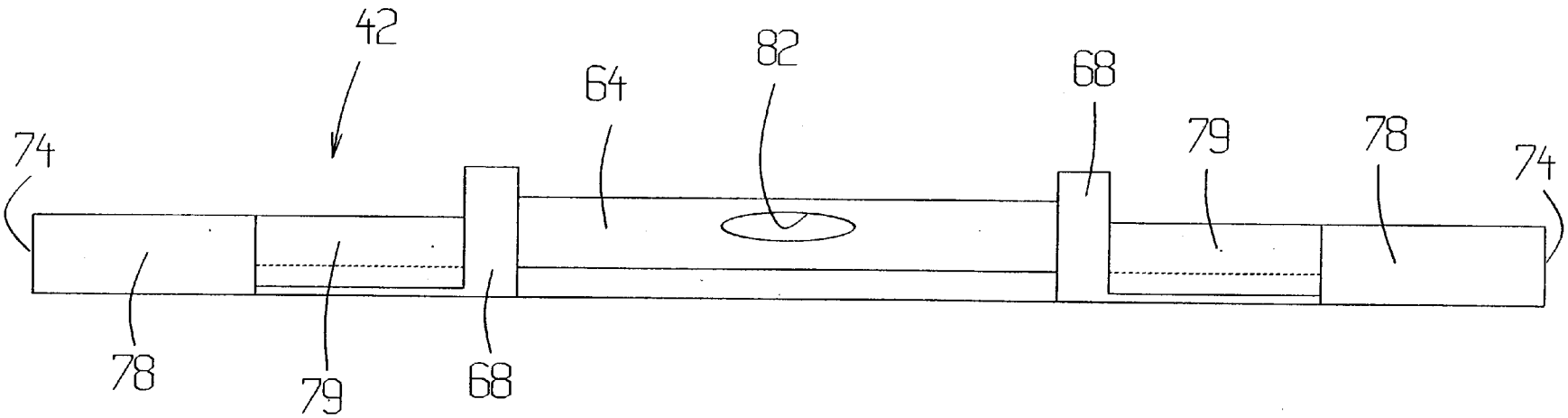
FIG. 14 is a top plan view of the second retainer.

As best shown in FIGS. 1–3, base 14 is in the form of a shell half and includes a bottom wall 18 and an upstanding peripheral side wall 20 extending upwardly therefrom, and specifically, a front wall 22, side walls 24 and 26 and rear wall 28 that form an essentially square configuration, although the present invention is not limited to this number of walls or this configuration. A cavity is defined between bottom wall 18 and peripheral walls 22, 24, 26 and 28. The outer surface of peripheral side wall 20 at the corners where walls 22, 24, 26 and 28 meet are preferably rounded, although the present invention is not limited thereto. The upper surfaces 30 of walls 22, 24, 26 and 28 are preferably coplanar, and the upper end of base 14 is open. Top cover 12 in like manner includes a top wall 18' and peripheral walls 22', 24', 26' and 28' forming an upstanding peripheral side wall 20' with lower coplanar surfaces 30'.

A slot 32 is formed in rear wall 28, and extends between the exterior and interior surfaces of rear wall 28. Slot 32 extends almost the entire length of rear wall 28. Preferably, the lower surface of slot 32 includes a central flat portion 34 which leads into upwardly curved portions 36 at opposite sides thereof. A central rectangular opening 38 is provided at the interior surface of rear wall 28, and has a side to side dimension substantially equal to the length of central flat portion 34 so as to be coextensive therewith. Thus, opening 38 provides open communication between slot 32 and the interior cavity of base 14. In like manner, a slot 32' of identical shape and size to slot 32 is formed in rear wall 28', and extends between the exterior and interior surfaces of rear wall 28'. Also, a central rectangular opening 38' is provided at the interior surface of rear wall 28' and provides open communication between slot 32' and the interior cavity of top cover 12.

In order to connect top cover 12 and base 14, spring hinge 16 includes a first retainer 40 mounted within slot 32 and opening 38 of base 14 and a second retainer 42 mounted within slot 32' and opening 38' of top cover 12, with a C-clip 17 having a first end connected to first retainer 40 and a second opposite end connected to second retainer 42. First retainer 40, second retainer 42 and C-clip 17 together form spring hinge 16 which connects together top cover 12 and base 14 in such a manner so as to provide a combined pivoting movement and sliding or linear movement of top cover 12 relative to base 14 during opening and closing of top cover 12.

Referring now to FIGS. 1 and 5–9, first retainer 40 is fixedly positioned in slot 32 and opening 38 of base 14 by a friction fit and/or is secured therein by an adhesive. First retainer 40 includes a planar rectangular central wall 44 having an undercut 46 at the lower end of the rear side. Two vertically extending flanges 48 extend slightly forwardly from opposite sides of wall 44 so that when first retainer 40 is inserted within slot 32, flanges 48 fit snugly within opening 38 of base 14.

Two generally quarter arcuate end sections 50 are provided, one on each side of central wall 44 and flanges 48, and integrally connected thereto as a one-piece structure. Thus, each arcuate section 50 includes a lower surface 52 that curves upwardly toward the outer ends, and which leads into a flattened or planar end wall 54. Curved lower surfaces 52 have a curvature similar to the curvature of upwardly curved portions 36 so as to rest thereon when first retainer 40 is inserted within slot 32. The distance between planar end walls 54 is similar to the length of slot 32 in base 14 so that first retainer 40 fits snugly therein. It will be appreciated that the present invention is not limited to the particular shape of first retainer 40 that is shown. Further, for larger jewelry boxes, two or more slots 32 and corresponding openings 38 can be provided, with a first retainer 40 in each slot 32 and corresponding opening 38.

The upper ends of arcuate sections 50 extend above upper surface 30 of rear wall 28 when first retainer 40 is inserted within slot 32 in base 14. In this regard, in the closed condition of jewelry case 10, the upper ends of arcuate sections 50 which extend above upper surface 30 of rear wall 28, extend into slot 32' in top cover 12. Further, each arcuate section 50 includes an upper cut-away section 58 which extends from the respective flange 48 to approximately one-half of the distance to the respective end wall 54, with cut-away sections 58 extending below upper surface 30 of rear wall 28 when first retainer 40 is inserted within slot 32 in base 14. The present invention is not limited to this distance, so that the length of cut-away sections 58 can vary. The portions of the upper ends of arcuate sections 50 which extend above upper surface 30 of rear wall 28, thereby form stops 59, as will be understood from the discussion hereafter. It will be appreciated that more than two stops 59 can be provided.

It is also noted that the rear surfaces of central wall 44 and quarter arcuate sections 50 are coplanar and together form a continuous rear wall of first retainer 40. At least one recess or groove 60 extends lengthwise of this continuous rear wall, as shown best in FIG. 6, although the present invention does not require groove 60. Adhesive can be placed in groove 60 for adhering first retainer 40 in slot 32 of base 14.

Referring now to FIGS. 1 and 10–14, second retainer 42 is fixedly positioned in slot 32' and opening 38' of top cover 12 by a friction fit or secured by an adhesive. Second retainer 42 includes a rectangular central wall 64 which generally tapers in thickness from a lower end to an upper end thereof, and which has an undercut 66 at the lower end of the rear side. Preferably, the thickness of central wall 64 is less than the thickness at the upper end of central wall 44, the reasons for which will become apparent from the discussion hereinafter. Two vertically extending flanges 68 extend slightly forwardly from opposite sides of wall 64 so that when second retainer 42 is inserted within slot 32', flanges 68 fit snugly within opening 38' of top cover 12.

Two generally quarter arcuate end sections 70 are provided, one on each side of central wall 64 and flanges 68, and integrally connected thereto as a one-piece structure. Thus, each arcuate section 70 includes a lower surface 72 that curves upwardly toward the outer ends, and which leads into a flattened or planar end wall 74. Curved lower surfaces 72 have a curvature similar to the curvature of the upwardly curved portions of top cover 12 so as to rest thereon when second retainer 42 is inserted within slot 32'. The distance between planar end walls 74 is similar to the length of slot 32' in top cover 12 so that second retainer 42 fits snugly therein. It will be appreciated that the present invention is not limited to the particular shape of second retainer 42 that is shown. Further, for larger jewelry boxes, two or more slots 32' and corresponding openings 38' can be provided, with a second retainer 42 in each slot 32' and corresponding opening 38'.

Upper ends of arcuate sections 70 extend above upper surface 30' of rear wall 28' when second retainer 42 is inserted within slot 32' in top cover 12. In this regard, in the closed condition of jewelry case 10, the upper ends 79 of arcuate sections 70 which extend above upper surface 30' of rear wall 28', extend into slot 32 in base 14 in opposition to upper cut-away sections 58. Further, each arcuate section 70 includes an upper cut-away section 78 which extends from the respective end wall 74 to approximately one-half of the distance to the respective flange 48, with cut-away sections 78 extending below upper surface 30' of rear wall 28' when second retainer 42 is inserted within slot 32' in top cover 12. The present invention is not limited to this distance, so that the length of cut-away sections 78 can vary. In the closed condition, the upper ends 79 of arcuate sections 50 which extend above upper surface 30 of rear wall 28 of base 14, extend into slot 32' in top cover 12 in opposition to upper cut-away sections 78. It will be appreciated that more than two upper ends 79 can be provided.

It is also noted that the rear surfaces of central wall 64 and quarter arcuate sections 70 are coplanar and together form a continuous rear wall of second retainer 42. At least one recess or groove 80 extends lengthwise of this continuous rear wall, as shown best in FIG. 10, although the present invention does not require groove 80. Adhesive can be placed in groove 80 for adhering second retainer 42 in slot 32' of top cover 12. For this same purpose, a central opening 82 can be provided in central wall 64, that is, to receive adhesive therein, although the present invention does not require central opening 82.

Referring now to FIGS. 1, 15 and 16, C-clip 17 is a metal or plastic leaf spring, for example, made of spring steel, stainless steel, etc., and having a thin arcuate main body 84 which terminates in inwardly turned lips 86 at the opposite ends thereof. One inwardly turned lip 86 grasps the lower end of central wall 44 of first retainer 40, while the other inwardly turned lip 86 grasps the upper end of central wall 64 of second retainer 42.

The height of central wall 44 of first retainer 40 is preferably less than the height of central wall 64 of second retainer 42 by a small amount. For example, while the height of central wall 44 can be 9 mm, the height of central wall 64 can be 11 mm. This is important for providing control of the combined rolling or pivoting movement of top cover 12 relative to base 14, and the forward sliding or linear movement of top cover 12 relative to base 14 when closing top cover 12. Of course, as will be appreciated, central wall 44 can have a greater height than central wall 64. In such case, there will be a pivoting and sliding movement of base 14 on top cover 12. It is preferred that the heights be different to control whether the rear edge of top cover 12 slides on upper surface 30 of base 14 or whether the rear edge of base 14 slides on upper surface 30' of top cover 12. Of course, it is still possible within the context of the present invention to make the heights of central walls 44 and 64 equal. However, in such case, which half slides on the other can change for each opening and closing operation.

Figure 4:
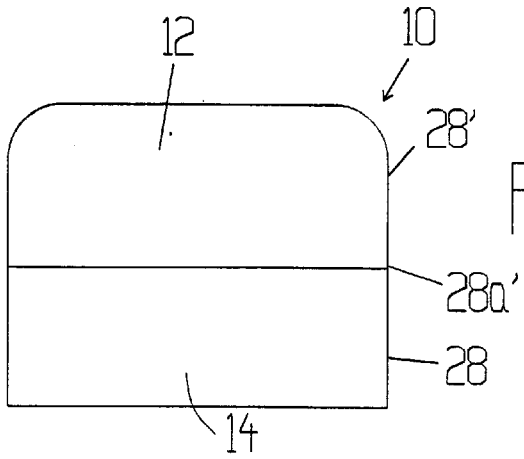
FIG. 4 is a side elevational view of the jewelry case in a fully closed condition.

As shown in FIG. 4, when jewelry case 10 is closed, the peripheral edges of top cover 12 and base 14 are substantially coincident, that is, in perfect alignment with each other. As top cover 12 is opened, the force of C-clip 17 tends to oppose the opening force until top cover 12 reaches a predetermined angle, which is preferably about 30 degrees. At this point, the rear edge **28*a*' of rear wall 28' of top cover 12 pivots relative to base 14. Rear edge 28*a*' pivots on upper surface 30 of rear wall 28 of base 14. However, in addition to this pivoting action, C-clip 17 pulls rear edge 28*a*' inwardly of base 14 until top surface 30' of rear wall 28' of top cover 12 abuts against stops 59, thereby also providing a sliding or linear movement of top cover 12 relative to base 14. This is a result of the different heights of central walls 44 and 64 and the different thicknesses at the engaged portions of central walls 44 and 64. Because of the different thicknesses, during an opening operation, C-clip 17 will first hit against thicker central wall 44 which will cause top cover 12** to be pulled inwardly. Therefore, both the heights and thicknesses together are factors in the sliding movement, although the height or thickness alone can be used and will each individually accomplish the same result.

In like manner, when closing jewelry case 10, as top cover 12 is closed, the force of C-clip 17 tends to oppose the closing force until top cover 12 reaches a predetermined angle, which is preferably about 30 degrees. At this point, the rear edge **28*a*' of rear section 28' of top cover 12 functions as a pivot axis about which top cover 12 pivots relative to base 14. Rear edge 28*a*' pivots on upper surface 30 of rear wall 28 of base 14. However, in addition to this pivoting movement, C-clip 17 pushes rear edge 28*a*' outwardly of base 14 until top surface 30' of rear section 28' of top cover 12 and top surface 30 of rear section 28 of base 14 are in alignment, as shown in FIG. 4**. Accordingly, a reverse sliding or linear movement is provided again, in addition to the pivoting movement.

Jewelry case 10 thereby provides that the spring hinge is not visible from the exterior of case 10. In order to accomplish this result, the pivot axis moves or slides during the opening and closing of the case. Specifically, spring hinge 16 also functions to move the rear pivoting edge **28*a*' of top cover 12 inwardly during a closing operation so as to provide a sliding action as well as a pivoting or rolling action. Further, spring hinge 16 has the function to automatically force top cover 12 into an open position during an opening operation and into a closed position during a closing operation after top cover 12 has pivoted a predetermined angle relative to base 14**.

It will be appreciated that, while case 10 has been discussed in relation to a jewelry case, the present invention is not limited thereby, and case 10 can be any case, regardless of the application.

With the above in mind, it will be appreciated that the aforementioned assembly of C-clip 17, slots 32 and 32', openings 36 and 36', first retainer 40 and second retainer 42 substantially detract from the appearance of jewelry case 10. For this reason, a fabric insert 100 is inserted within jewelry case 10 to provide an aesthetic appearance, while at the same time covering and hiding the aforementioned elements. Conventionally, fabric inserts have been glued or otherwise adhered within jewelry cases. The fabric inserts also function to hold jewelry in jewelry case 10 as well. However, this results in an additional material, namely the adhesive. Also, positioning of the fabric inserts in a jewelry case with an adhesive is a difficult job, since alignment must be perfect before the adhesive dries. Further, if the fabric inserts become soiled or otherwise need to be changed, there is no way to replace the fabric inserts, and as a result, the entire jewelry case must be thrown away. This is because the fabric insert is permanently mounted in the case.

The present invention avoids this problem by providing an inwardly extending retaining ledge 92 at the lower edge of peripheral side wall 20' of top cover 12 and an inwardly extending retaining ledge 94 at the upper edge of peripheral side wall 20 of base 14. The lower surface of inwardly extending retaining ledge 92 is coplanar and forms a continuation of lower surface 30', while the upper surface of inwardly extending retaining ledge 94 is coplanar and forms a continuation of upper surface 30. With the present invention, it is only necessary to position fabric insert 100 within top cover 12 and base 14, and beneath retaining ledges 92 and 94 in order to removably hold fabric insert 100 in place. If it is necessary to realign or change fabric insert 100, this can easily be accomplished by merely pulling out fabric insert 100 and replacing it with a new fabric insert. Fabric insert 100 can be made of any suitable fabric material, as is conventional.

Figure 17:
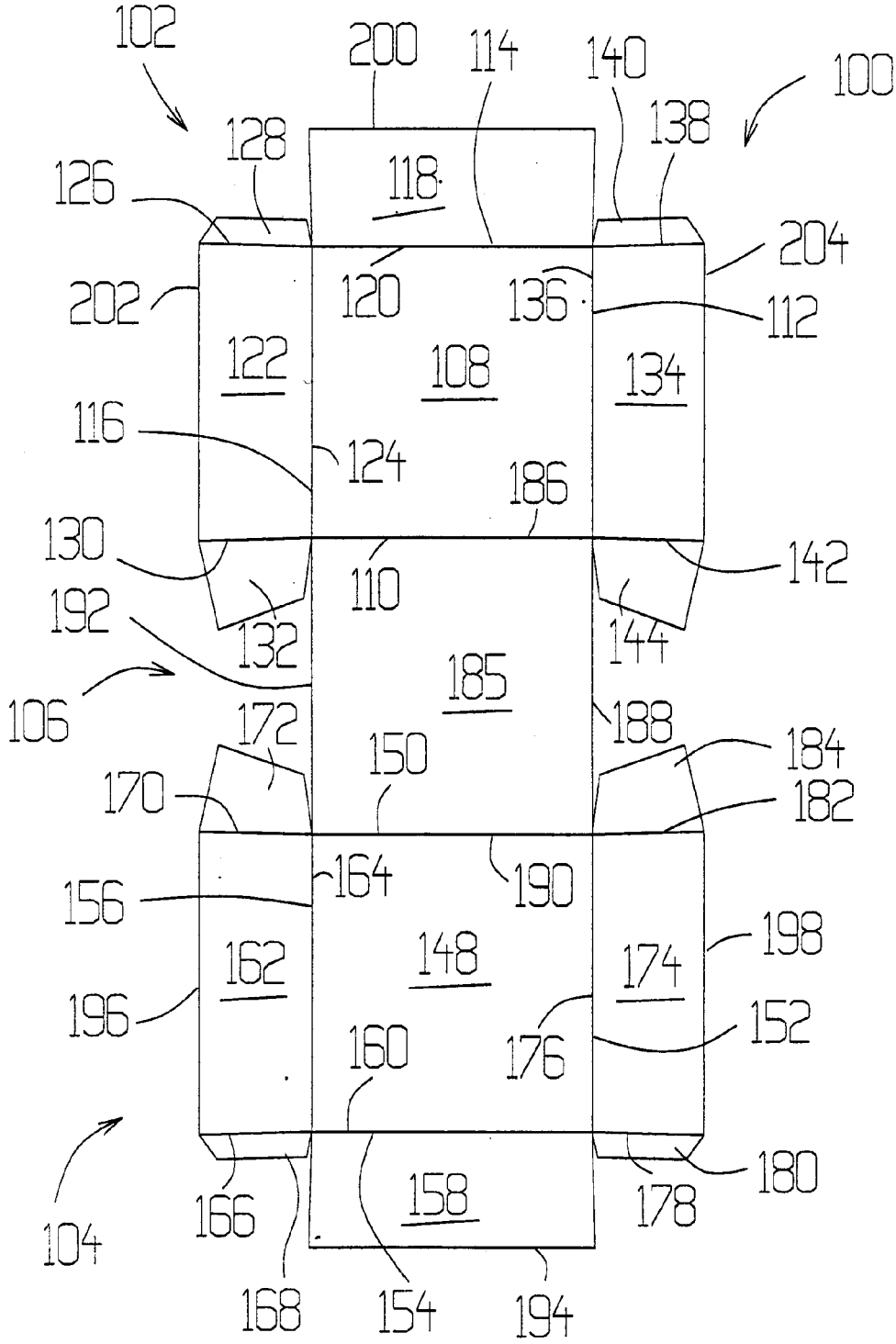
FIG. 17 is a plan view of a blank of a fabric insert to be positioned within the jewelry case.
Figure 18:
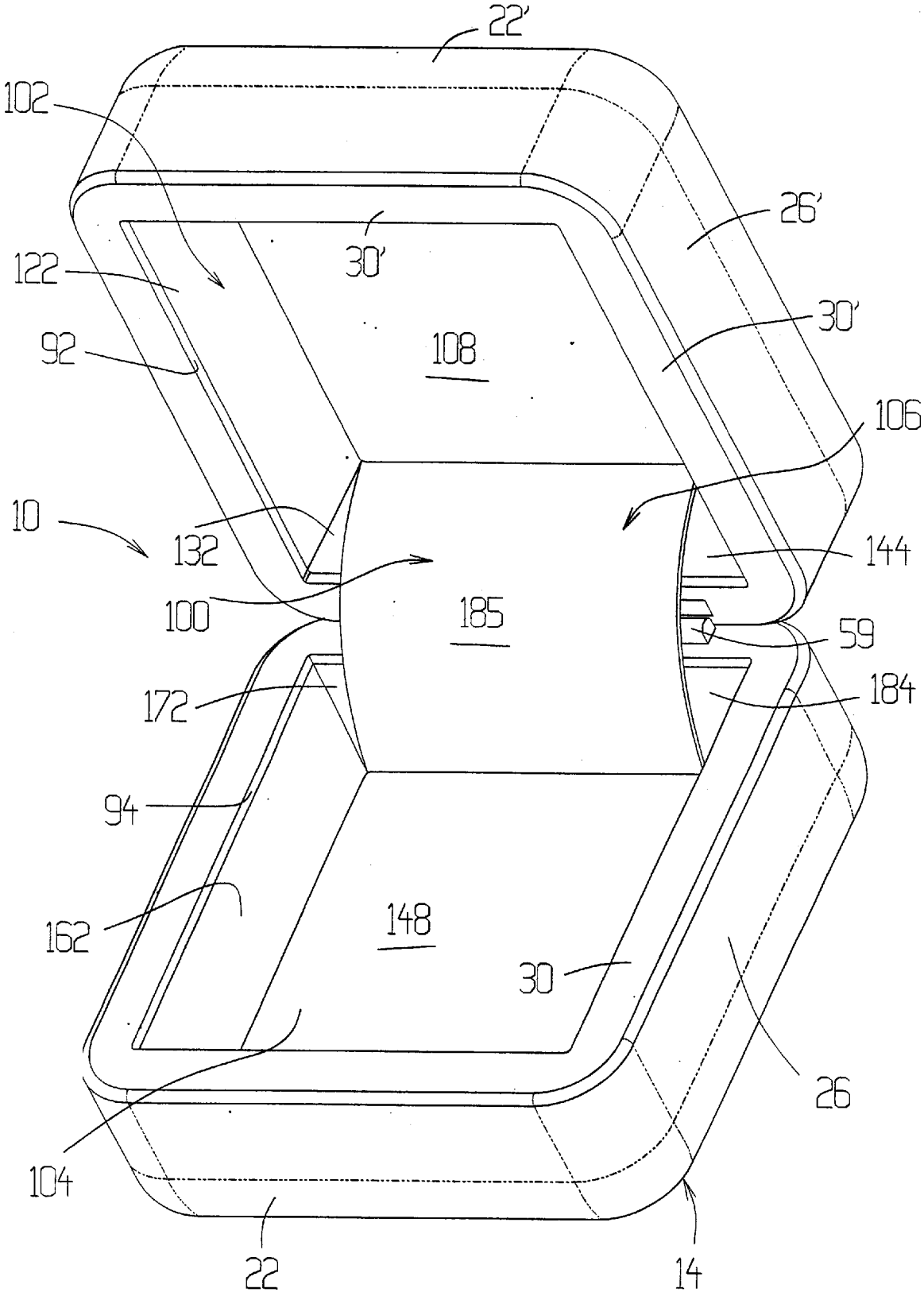
FIG. 18 is a perspective view, showing the fabric insert positioned within the jewelry case.

Specifically, as shown in FIG. 17, fabric insert 100 includes top covering section 102, a base covering section 104 and a hinge covering section 106. Top covering section 102 includes a first substantially square section 108 for covering the inner surface of top wall 18' and having edges 110, 112, 114 and 116. A slightly trapezoidal shaped end section 118 for covering the inner surface of front wall 22' has its shorter parallel edge 120 connected and coincident with edge 114 so as to define a fold line thereat.

A first generally rectangular wall 122 for covering the inner surface of side wall 24' has one long edge 124 connected and coincident with edge 116 so as to define a fold line thereat. A shorter edge 126 adjacent to end section 118 is connected with a short flap 128 at a fold line, and the opposite shorter edge 130 is also connected with a short flap 132 at a fold line. In like manner, a second generally rectangular wall 134 for covering the inner surface of side wall 26' has one long edge 136 connected and coincident with edge 112 so as to define a fold line thereat. A shorter edge 138 adjacent to end section 118 is connected with a short flap 140 at a fold line, and the opposite shorter edge 142 is also connected with a short flap 144 at a fold line.

Bottom covering section 104 includes a first substantially square section 148 for covering the inner surface of bottom wall 18 and having edges 150, 152, 154 and 156. A slightly trapezoidal shaped end section 158 for covering the inner surface of front wall 22 has its shorter parallel edge 160 connected and coincident with edge 154 so as to define a fold line thereat.

A first generally rectangular wall 162 for covering the inner surface of side wall 24 has one long edge 164 connected and coincident with edge 156 so as to define a fold line thereat. A shorter edge 166 adjacent to end section 158 is connected with a short flap 168 at a fold line, and the opposite shorter edge 170 is also connected with a short flap 172 at a fold line. In like manner, a second generally rectangular wall 174 for covering the inner surface of side wall 26 has one long edge 176 connected and coincident with edge 152 so as to define a fold line thereat. A shorter edge 178 adjacent to end section 158 is connected with a short flap 180 at a fold line, and the opposite shorter edge 182 is also connected with a short flap 184 at a fold line.

Hinge covering section 106 has a generally square panel 185 with edges 186, 188, 190 and 192, with edge 186 being connected and coincident with edge 110 along a fold line and edge 190 being connected and coincident with edge 150 along a fold line.

In order to position fabric insert 100 in jewelry case 10, first substantially square section 148 is positioned on bottom wall 18 of base 14. Trapezoidal shaped end section 158 is positioned against front wall 22, first generally rectangular wall 162 is positioned against side wall 24 and second generally rectangular wall 174 is positioned against side wall 26. In addition, short flaps 168 and 180 are folded along their fold lines so as to be positioned against front wall 22 and behind trapezoidal shaped end section 158 so as to present a substantial continuity to fabric insert 100. Short flaps 172 and 184 are positioned against rear wall 28 behind first substantially square section 185 of spring covering section 106.

It will be appreciated, however, in accordance with the present invention, that the opposite long edges 194, 196 and 198 of trapezoidal shaped end section 158, first generally rectangular wall 162 and second generally rectangular wall 174, respectively, are held under inwardly extending retaining ledge 94. These opposite long edges are therefore obscured from view, while also retaining base covering section 104 in position without adhesive. In such case, it is not necessary that section 158 and walls 162 and 174 contact front wall 22 and side walls 24 and 26, respectively, since there may be bulging out. It is only necessary for edges 194, 196 and 198 to be held by the lower surface of ledge 94. However, it is preferable that the inner upper portions of the corners of walls 22, 24 and 26 be contacted by fabric insert 100 in order to correctly align fabric insert 100 in case 10.

In like manner, first substantially square section 108 is positioned against top wall 18' of top cover 12. Trapezoidal shaped end section 118 is positioned against front wall 22', first generally rectangular wall 122 is positioned against side wall 24' and second generally rectangular wall 134 is positioned against side wall 26'. In addition, short flaps 128 and 140 are folded along their fold lines so as to be positioned against front wall 22' and behind trapezoidal shaped end section 118 so as to present a substantial continuity to fabric insert 100. Short flaps 132 and 144 are positioned against rear wall 28' behind first substantially square section 185 of spring covering section 106.

As discussed above, the opposite long edges 200, 202 and 204 of trapezoidal shaped end section 118, first generally rectangular wall 122 and second generally rectangular wall 134, respectively, are held under inwardly extending retaining ledge 92. These opposite long edges are therefore obscured from view, while also retaining top covering section 102 in position without adhesive. In such case, it is not necessary that section 118 and walls 122 and 134 contact front wall 22' and side walls 24' and 26', respectively, since there may be bulging out. It is only necessary for edges 200, 202 and 204 to be held by the upper surface of ledge 92. However, it is preferable that the inner lower portions of the corners of walls 22', 24' and 26' be contacted by fabric insert 100 in order to correctly align fabric insert 100 in case 10.

It will be appreciated that the present invention of inwardly extending retaining ledges 92 and 94 can be used with any hinged jewelry case, and is not limited to the jewelry case 10 disclosed herein.

Further, with the present invention, the inward extension of ledges 92 and 94 can be different for different walls and can even be eliminated for some walls, without detracting from the aesthetic appearance, and while still providing the same functionality. For example, by providing a greater inward extension of ledges 92 and 94, not only can fabric inserts 100 be held, but also, much larger and thicker jewelry pads, such as ring pads, watch pads, etc. can be held by ledges 92 and 94.

Figure 19:
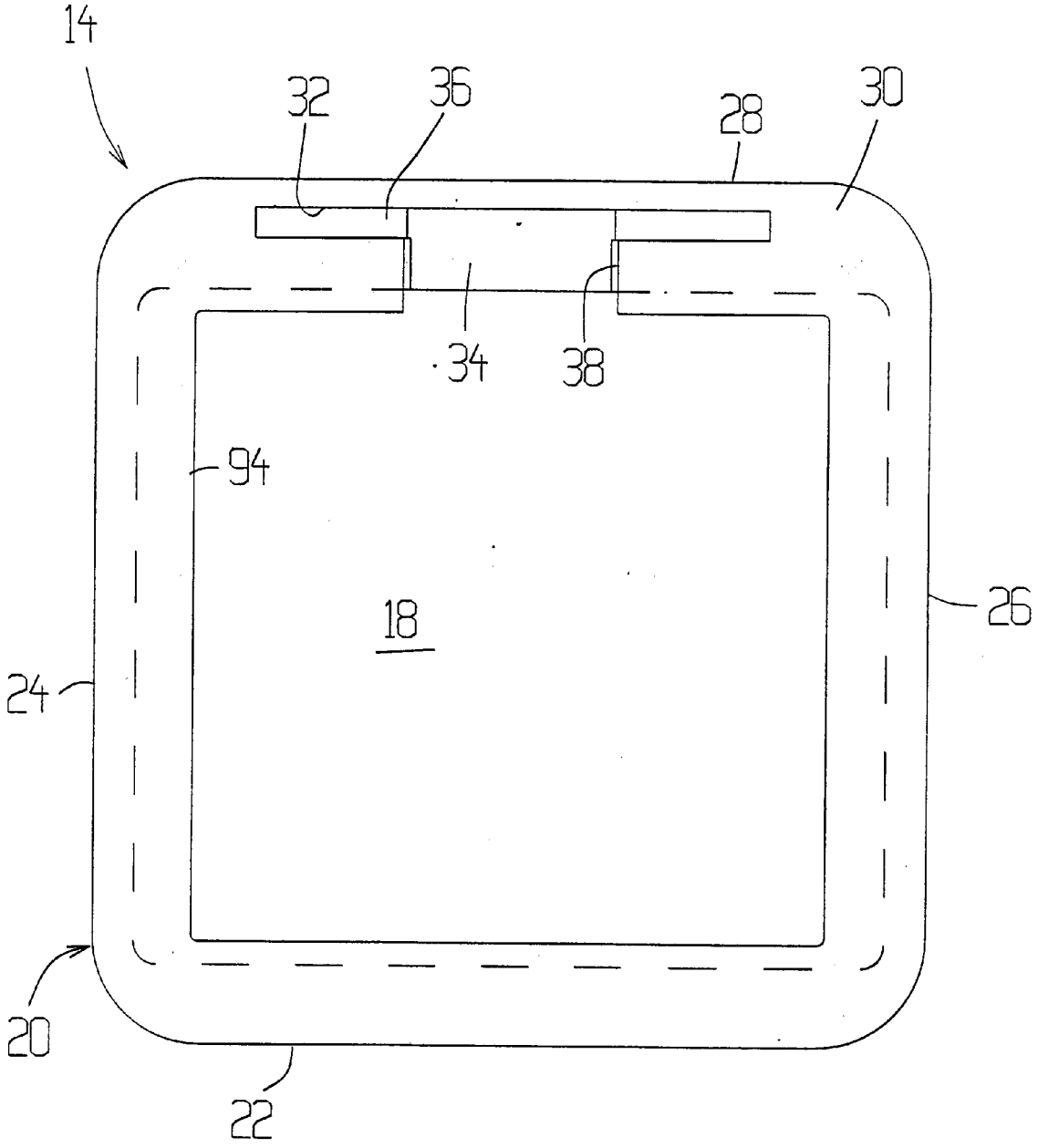
FIG. 19 is a top plan view of a base according to a modified embodiment of the present invention.
Figure 20:
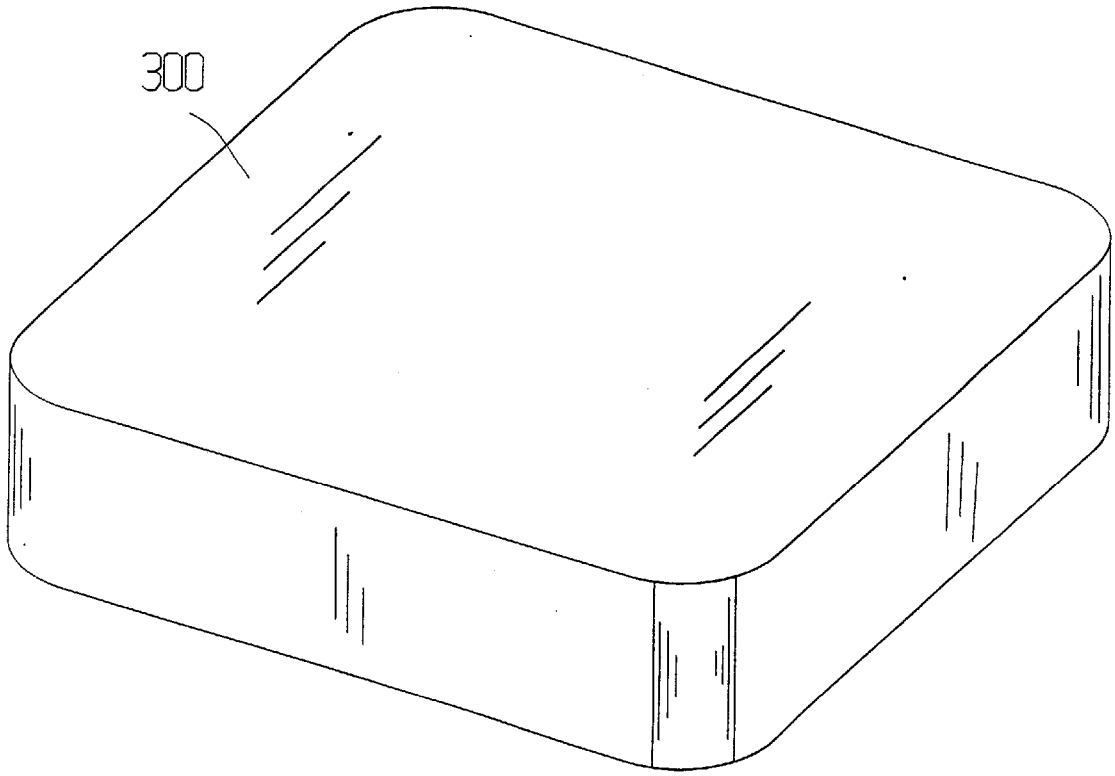
FIG. 20 is a perspective view of a jewelry pad for insertion into the base of FIG. 19.

In this regard, reference is made to FIG. 19 in which a modified base 14 is provided which is identical to base 14 except that inwardly extending retaining ledge 94 at the upper edge of peripheral side wall 20 of base 14 extends inwardly a greater distance at side walls 24 and 26 than at front wall 22 and rear wall 28. The reason for this is that a thick jewelry pad 300, as shown in FIG. 20, for holding jewelry items thereon, can be inserted under ledge 94 and held thereby. By increasing the inward extension of ledge 94 at side walls, it is assured that jewelry pad 300 will not inadvertently escape from base 14. Thus, jewelry pad 300 is positively held in base 14 without adhesive. Retaining ledge 94 at rear wall 28 can be eliminated so that retaining ledge 94 only extends along three sides. Of course, it will be appreciated that the fabric insert will still be covering base 14 beneath pad 300.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A case comprising:

a base including:

a bottom wall, a peripheral side wall connected to the bottom wall, said peripheral side wall of said base including a front wall, a rear wall and opposite side walls connecting together said front wall and said rear wall, and a first retaining ledge extending inwardly in substantially perpendicular relation from the upper end of the peripheral wall;

a top cover including:

a top wall, a peripheral side wall connected to the top wall such that a cavity is defined between the top wall and the peripheral side wall of the top cover and the bottom wall and the peripheral side wall of the base when the jewelry case is in a closed condition, said peripheral side wall of said top cover including a front wall, a rear wall and opposite side walls connecting together said front wall and said rear wall, and a second retaining ledge extending inwardly in substantially perpendicular relation from the lower end of the peripheral wall of the top cover;

a hinge which pivotally connects together the base and the top cover; and a fabric covering which covers inner surfaces of said top cover and said base, said fabric covering having edges retained under said first and second inwardly extending retaining ledges to retain said fabric covering in position without adhesive, said fabric covering including:

a top covering section which covers said inner surfaces of said top cover, said top covering section including a fourth section for covering said top wall, a fifth section connected along a fold line with said fourth section for covering one side wall of said top cover and a sixth section connected along a fold line with said fourth section for covering the other side wall of said top cover, and a bottom covering section which covers said inner surfaces of said base, said bottom covering section including a first section for covering said bottom wall, a second section connected along a fold line with said first section for covering one side wall of said base and a third section connected along a fold line with said first section for covering the other side wall of said base, and a hinge covering section which connects together said top covering section and said bottom covering section, said hinge covering section connecting the first and fourth sections together.

2. A case according to claim 1, wherein:

said peripheral side wall of said base has an upper surface, and said first inwardly extending retaining ledge has an upper surface which is coplanar and forms a continuation of the upper surface of said peripheral side wall of said base; and said peripheral side wall of said top cover has a lower surface, and said second inwardly extending retaining ledge has a lower surface which is coplanar and forms a continuation of the lower surface of said peripheral side wall of said top cover.

3. A case according to claim 2, wherein:

said first inwardly extending retaining ledge has a lower surface which is substantially parallel with the upper surface of said first inwardly extending retaining ledge and extends inwardly in substantially perpendicular relation from the respective peripheral side walls; and said second inwardly extending retaining ledge has an upper surface which is substantially parallel with the lower surface of said second inwardly extending retaining ledge and extends inwardly in substantially perpendicular relation from the respective peripheral side walls.

4. A case according to claim 1, wherein:

said peripheral side wall of said base has an upper surface, and said first inwardly extending retaining ledge has a lower surface which is substantially parallel with the upper surface of said first inwardly extending retaining ledge and extends inwardly in substantially perpendicular relation from the respective peripheral side walls; and said peripheral side wall of said top cover has a lower surface, said second inwardly extending retaining ledge has an upper surface which is substantially parallel with the lower surface of said second inwardly extending retaining ledge and extends inwardly in substantially perpendicular relation from the respective peripheral side walls.

* * * * *